US008454269B2

(12) United States Patent
Johnson et al.

(10) Patent No.: US 8,454,269 B2
(45) Date of Patent: Jun. 4, 2013

(54) FLOOD BARRIER OR THE LIKE AND METHOD OF USING THE SAME

(75) Inventors: William Nevil Heaton Johnson, St. Peter Port (GB); Alan Herd, Melton Mowbray (GB)

(73) Assignee: Wata-Wall Ltd., Surrey (GB)

( * ) Notice: Subject to any disclaimer, the term of this patent is extended or adjusted under 35 U.S.C. 154(b) by 159 days.

(21) Appl. No.: 12/669,439

(22) PCT Filed: Jul. 17, 2008

(86) PCT No.: PCT/GB2008/002445

§ 371 (c)(1),
(2), (4) Date: May 5, 2010

(87) PCT Pub. No.: WO2009/010756

PCT Pub. Date: Jan. 22, 2009

(65) Prior Publication Data

US 2010/0215436 A1 Aug. 26, 2010

(30) Foreign Application Priority Data

Jul. 17, 2007 (GB) ..... 0713871.2

(51) Int. Cl.
*E02B 7/02* (2006.01)
*F16L 25/00* (2006.01)

(52) U.S. Cl.
USPC ..... 405/110; 285/328

(58) Field of Classification Search
USPC ..... 405/15–17, 19, 21, 107, 110–112, 405/114; 404/6–9, 12; 285/67, 625, 330, 285/325, 328
See application file for complete search history.

(56) References Cited

U.S. PATENT DOCUMENTS

| | | | | |
|---|---|---|---|---|
| 4,688,337 | A * | 8/1987 | Dillner et al. | 24/616 |
| 4,773,629 | A * | 9/1988 | Yodock | 256/13.1 |
| 5,836,714 | A * | 11/1998 | Christensen | 404/6 |
| 6,004,067 | A | 12/1999 | Peppard | |
| 6,022,172 | A | 2/2000 | Siyaj | |
| 6,471,252 | B1 * | 10/2002 | Moretti et al. | 285/319 |
| 8,167,512 | B2 * | 5/2012 | Christensen | 404/6 |
| 2007/0154265 | A1 | 7/2007 | Stauffacher | |

FOREIGN PATENT DOCUMENTS

| | | | |
|---|---|---|---|
| CA | 2267025 | A1 | 9/2000 |
| WO | 03/010389 | A | 2/2003 |

OTHER PUBLICATIONS

De Coene, Petrus, International Search Report for PCT/GB2008/002445, Dec. 3, 2008.
A video clip from National Geographic's television show I Didn't Know That which aired in Dec. 2007, located at http://www.wata-wall.com. Accessed Feb. 7, 2013.
A promotional video produced by Spirit Film & TV Wata-Wall published in Jul. 2008, located at http://www.wata-wall.com. Accessed Feb. 7, 2013.
Screen capture of http://www.wata-wall.com. Accessed Feb. 7, 2013.

* cited by examiner

*Primary Examiner* — Sunil Singh
*Assistant Examiner* — Kyle Armstrong
(74) *Attorney, Agent, or Firm* — The Webb Law Firm, PC

(57) ABSTRACT

A flood defense or water-retaining device 8 comprises a hollow body of an elastomeric material having formations 30, 34 at opposite ends for sealing engagement with complementary formations on adjoining flood defense devices and having complementary formations 22, 24 on upper and lower sides for sealing engagement with complementary formations on lower and upper sides respectively of any similar devices disposed respectively above and below the first-mentioned device. The device 8 has at least one filling opening 40 through which water can be passed into the interior of the device to fill the same.

14 Claims, 10 Drawing Sheets

FLOOD BARRIER OR THE LIKE AND METHOD OF USING THE SAME

This is a national stage application filed under 35 USC 371 based on International Application No. PCT/GB2008/002445 filed Jul. 17, 2008, and claims priority under 35 USC 119 of United Kingdom Patent Application No. 0713871.2 filed Jul. 17, 2007.

THE PRESENT INVENTION relates to a device which can be used, in conjunction with similar devices, to form a barrier against flood water, in some situations, or to form, in other situations, a structure or reservoir in which water can be retained.

It is one of the objects of the present invention to provide a device which can serve the function traditionally served by sandbags, but which requires no sand or other ballast apart from water which is, by definition, readily available in flood situations at least. The device of the invention may also be used to retain water in areas of only occasional rainfall.

According to the invention there is provided a flood defence or water-retention device comprising a hollow body of an elastomeric material having formations at opposite ends for sealing engagement with complementary formations on adjoining flood defence devices and having complementary formations on upper and lower sides for sealing engagement with complementary formations on lower and upper sides respectively of any similar devices disposed respectively above and below the first-mentioned device, the device having at least one filling opening through which water can be passed into the interior of the device to fill the same.

The device may include a releasable closure for sealingly closing the said opening.

According to another aspect of the invention there is provided a flood defence and water-retaining structure comprising a plurality of devices as described in any of the preceding statements.

The devices may be filled with water. The devices may be connected one on top of another to form a sealed structure.

The devices may be connected end to end to form a sealed wall. The structure may, if necessary, comprise a second, third and so on course of such devices, to provide a sealed wall of the desired height.

Other aspects of the invention are as set out in the claims.

Embodiments of the invention are described below by way of example only with reference to the accompanying drawings in which.

Figure 1:
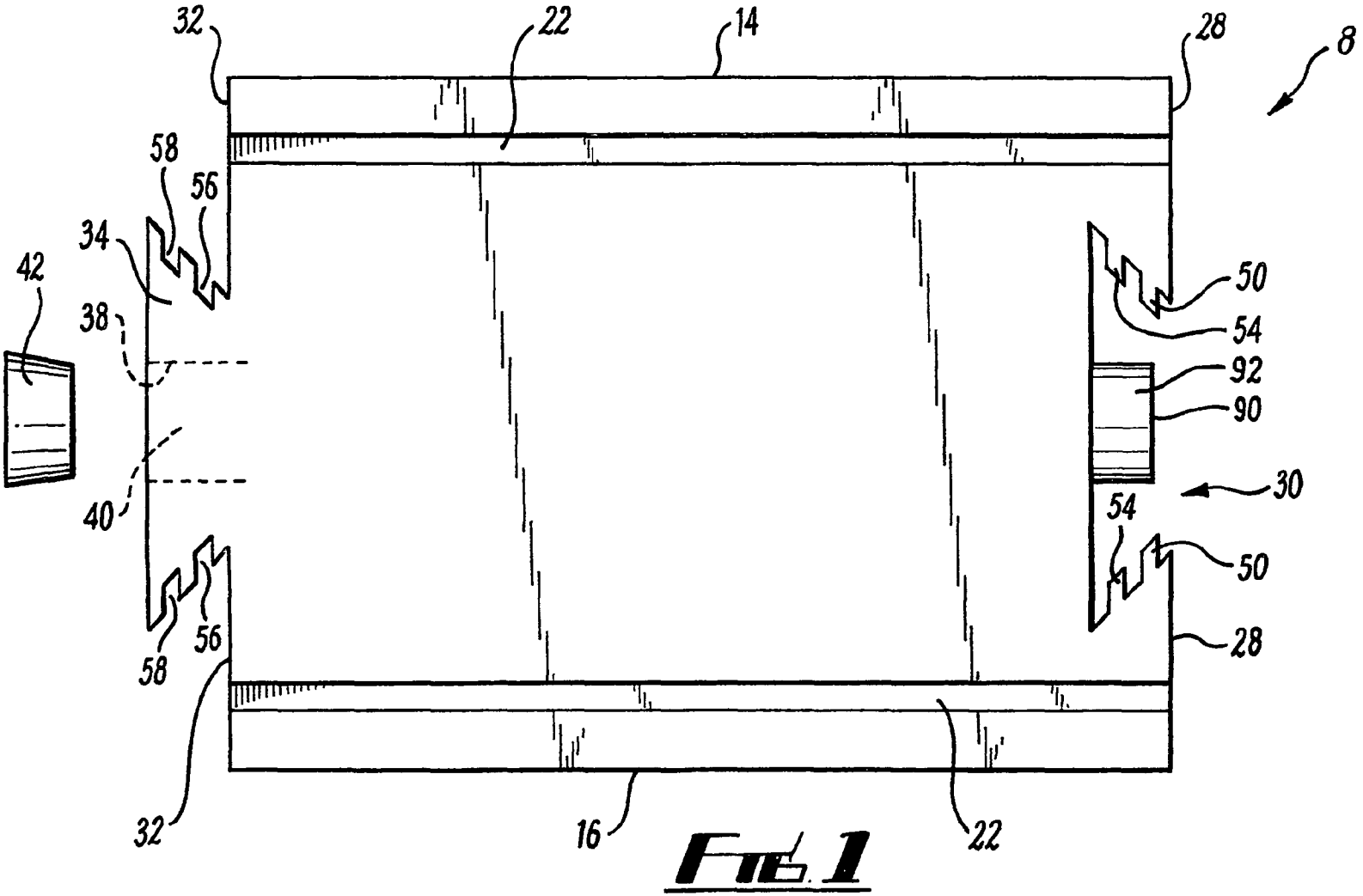
FIG. 1 is a view from above of a device embodying the invention.

Referring to the drawings, a device 8 embodying the invention comprises a hollow body of an elastomeric material such as polyurethane or rubber, the device having the general form of a rectangular block with an upper face 10, a lower face 12, side faces 14 and 16 and ends 18 and 20. The upper face of the device is generally flat but has two parallel longitudinal grooves 22 running from end to end of the device, parallel to and close to but spaced slightly from the side faces 14 and 16. The lower face 12 is likewise substantially planar except for upstanding ribs 24 which likewise extend from end to end of the device parallel with but spaced from the side faces 14, 16, the width, depth and location of the ribs 24 being such as to allow the device to be placed on top of an identical device with the ribs 24 extending into the grooves 22 of the device below, with the face 12 of the device engaging the face 10 of the device below and with the side faces 14, 16 of the device being substantially co-planar with the side faces 14, 16, respectively of the device below.

At one end of the device, co-planar end faces 28 extend from the respective side faces 14, 16, perpendicular to the latter, to respective edges of a retaining formation in the form of a generally dovetail-section groove 30 which extends from the upper face 10 to the lower face 12 and is preferably of constant cross-section, in a horizontal plane, throughout. At the other end of the device, co-planar end faces 32 extend from the respective side faces 14, 16, perpendicular to the latter and to the faces 10, 12, up to the root of a retaining formation if the form of a projection or tongue 34 which extends beyond the plane of the faces 32 and is of a constant cross-section, in a horizontal plane, complementary to that of the groove 30, throughout its extent from the upper surface 10 to the lower surface 12. The projection 34 and groove 30 thus comprise respective complementary retaining formations such that a plurality of devices identical with that shown may be arranged end to end, with the dovetail projection 34 of one engaged in the dovetail groove 30 of the next adjoining device and with the surfaces 32, 28 of the adjoining devices mating with one another and with the upper and lower surfaces, 10, 12 and the side faces 14, 16 of the adjoining devices being respectively co-planar.

Figure 3:
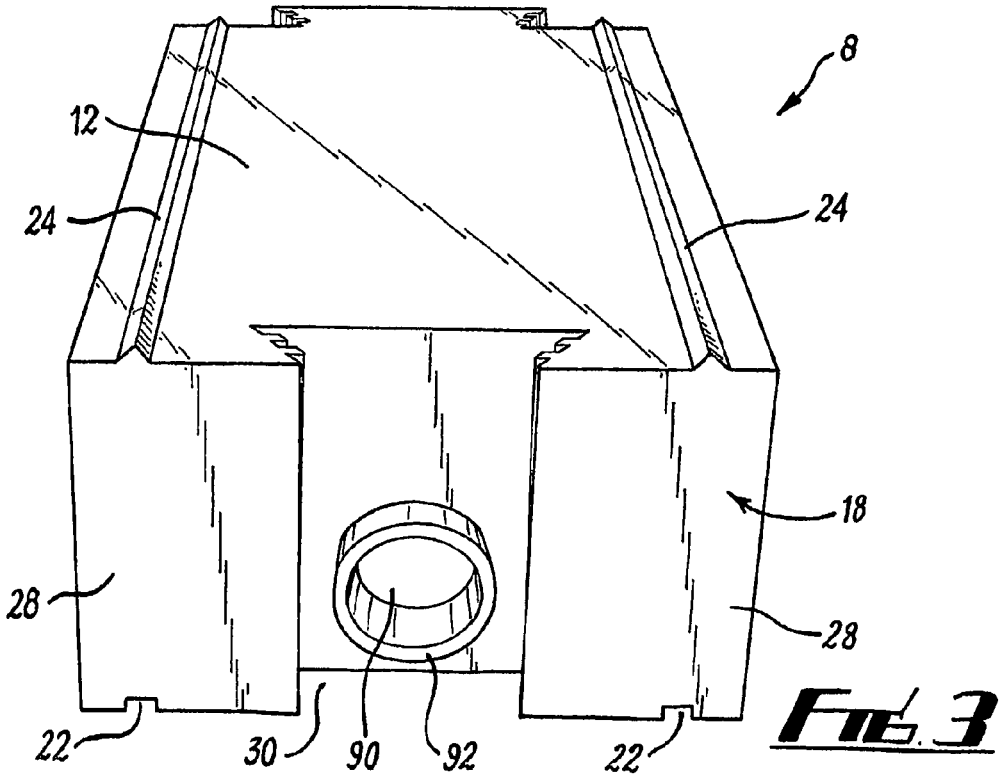
FIG. 3 is a view from below and from the other end of the device of FIGS. 1 and 2.
Figure 4:
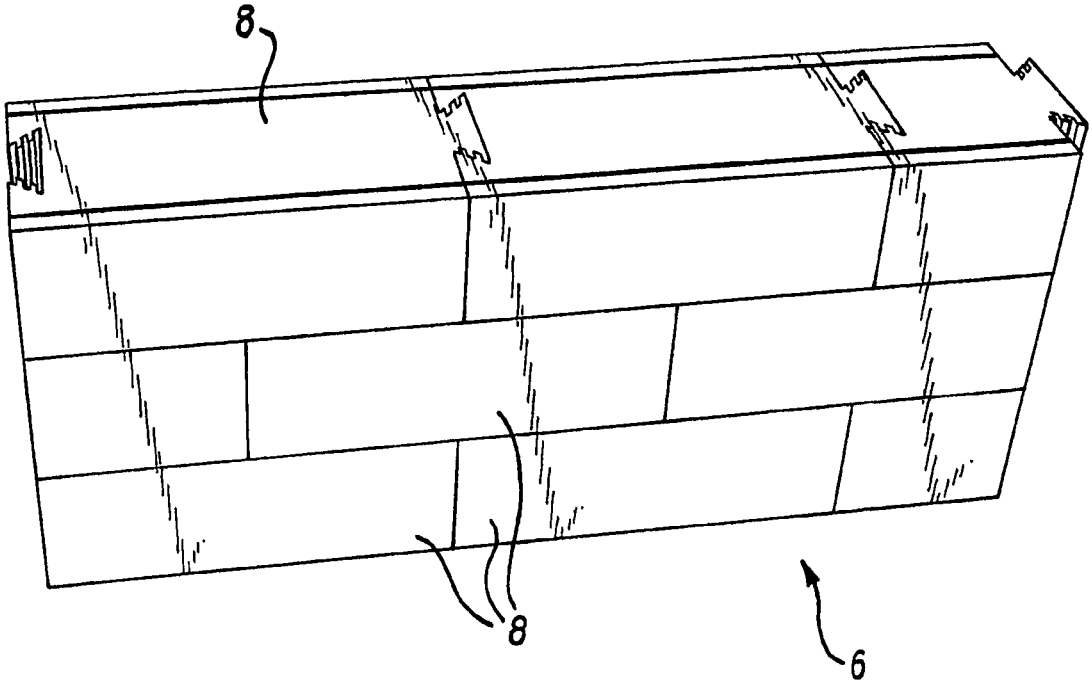
FIG. 4 is a perspective view of part of a flood barrier constructed using a plurality of devices identical with the device of FIGS. 1 to 3.

FIG. 4 illustrates a structure 6 in the form of a section of a barrier comprising three layers or courses of devices 8 according to FIGS. 1 to 3, each layer or course comprising a plurality of the devices laid end to end and with each course being engaged with the course below in the manner indicated above.

Each device has a socket 38 which defines an opening 40 communicating with a hollow interior 64 of the device and by way of which the device may be filled with water, the opening being thereafter sealed by a closure or bung 42 which fits releasably but sealingly in the opening 40 and may, for example, be arranged to screw into the opening 40, being flush with, or recessed with respect to, the face of the device in which the opening 40 is provided. In another example, the bung 42 is tapered in shape. Accordingly, the device may be filled with water, via the opening 40 and the opening sealed with the respective bung to afford a block of substantial weight which may be assembled with other such blocks in a manner indicated in FIG. 4, (likewise filled with water) to form a wall or barrier of sufficient weight to resist displacement by a body of water on one side of the barrier. The moderate flexibility of the devices allows these to adapt to slightly uneven ground surfaces to ensure an adequate seal with the latter. However, if desired, the wall or barrier may be laid upon suitable matting, for example, resilient matting, laid on the ground surface. It will be understood that, if necessary, such wall or barrier may be braced by posts or other supports placed on the side of the wall opposite the body of water behind the wall.

Referring again to FIG. 5, it will be noted that the flanks of the dovetail are not simple inclined planar surfaces, (although in other variants they may be), but that the flanks of the groove 30 have each, at a location relatively near to the respective surface 28, a first rib 50 extending laterally inwards with respect to the notional planar dovetail face, and, further from the face 28, a further second rib 54 projecting from the plane of the notional dovetail face. The complementary dovetail projection 34 has, likewise, on each flank, a laterally inwardly projecting first groove 56 in which the corresponding first rib 50 of an adjoining device 8 engages when the devices 8 are fitted end to end, and a further laterally inwardly projecting second groove 58 which receives the corresponding second rib 54 of the adjoining device 8. This arrangement enhances the sealing tightness of the connection between adjacent devices or devices 8 connected end to end.

Figure 5:
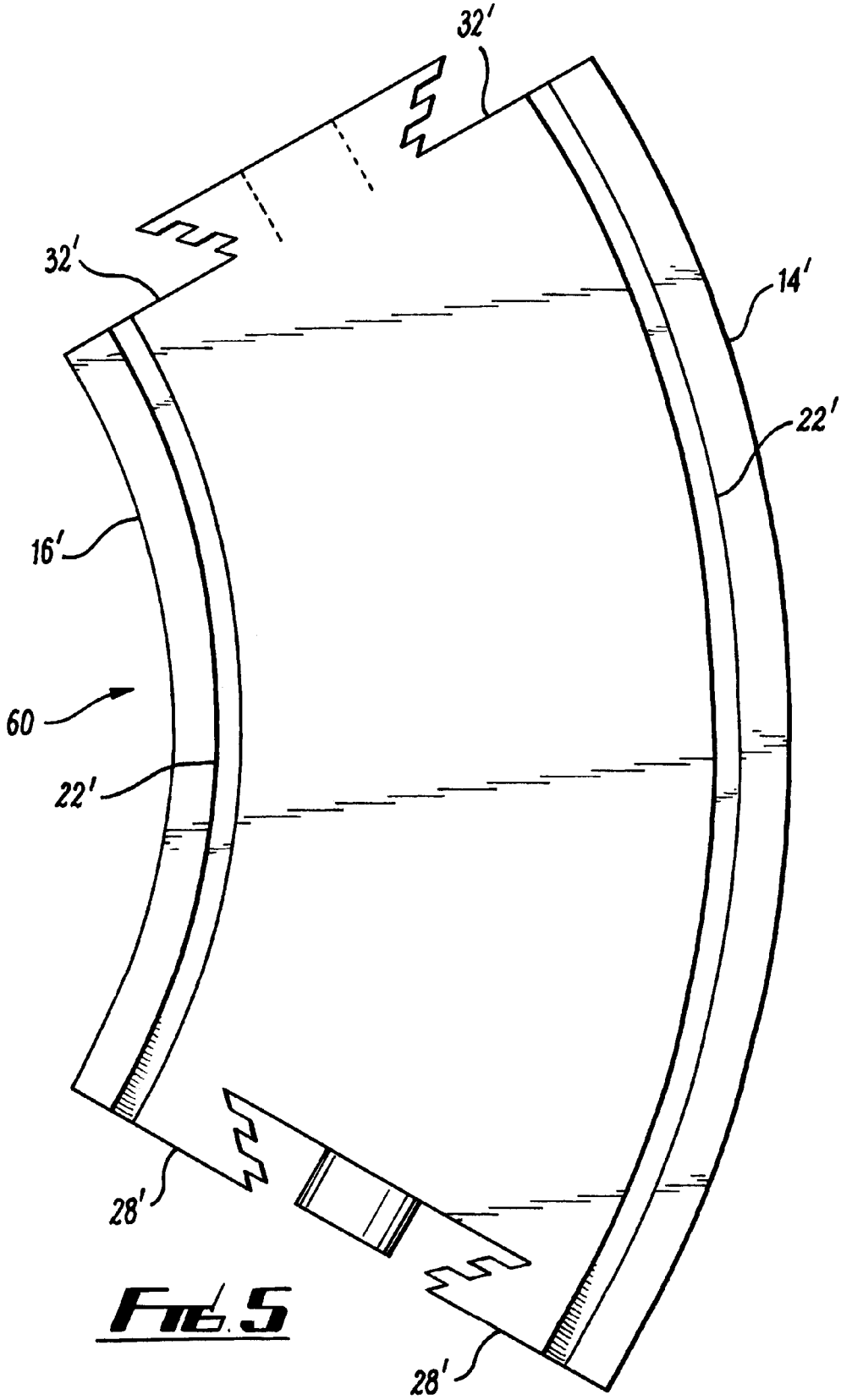
FIGS. 5 and 6 are plan views of variant devices.

The devices 8 described above with reference to FIGS. 1 to 4 may form part of a barrier system which includes, for example, elements such as the element illustrated in plan in FIG. 5 at 60 which has the general form of a device corresponding to that of FIGS. 1 to 4 but which is curved about a vertical axis so that the side surfaces 14', 16' are respectively convex and concave, with the ribs and grooves 24', 22' (corresponding to the ribs and grooves 24, 22 in FIGS. 1 to 4), being correspondingly curved and with the end faces indicated at 28', 32' being inclined with respect to each other.

Figure 2:
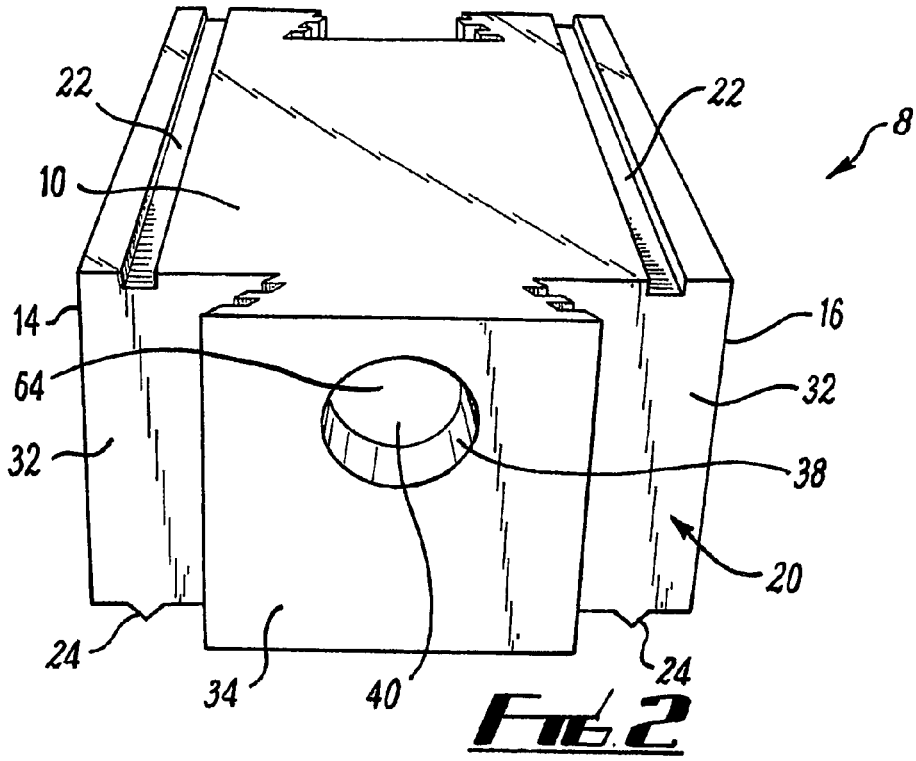
FIG. 2 is a perspective view from above and one end of the device of FIG. 1.
Figure 6:
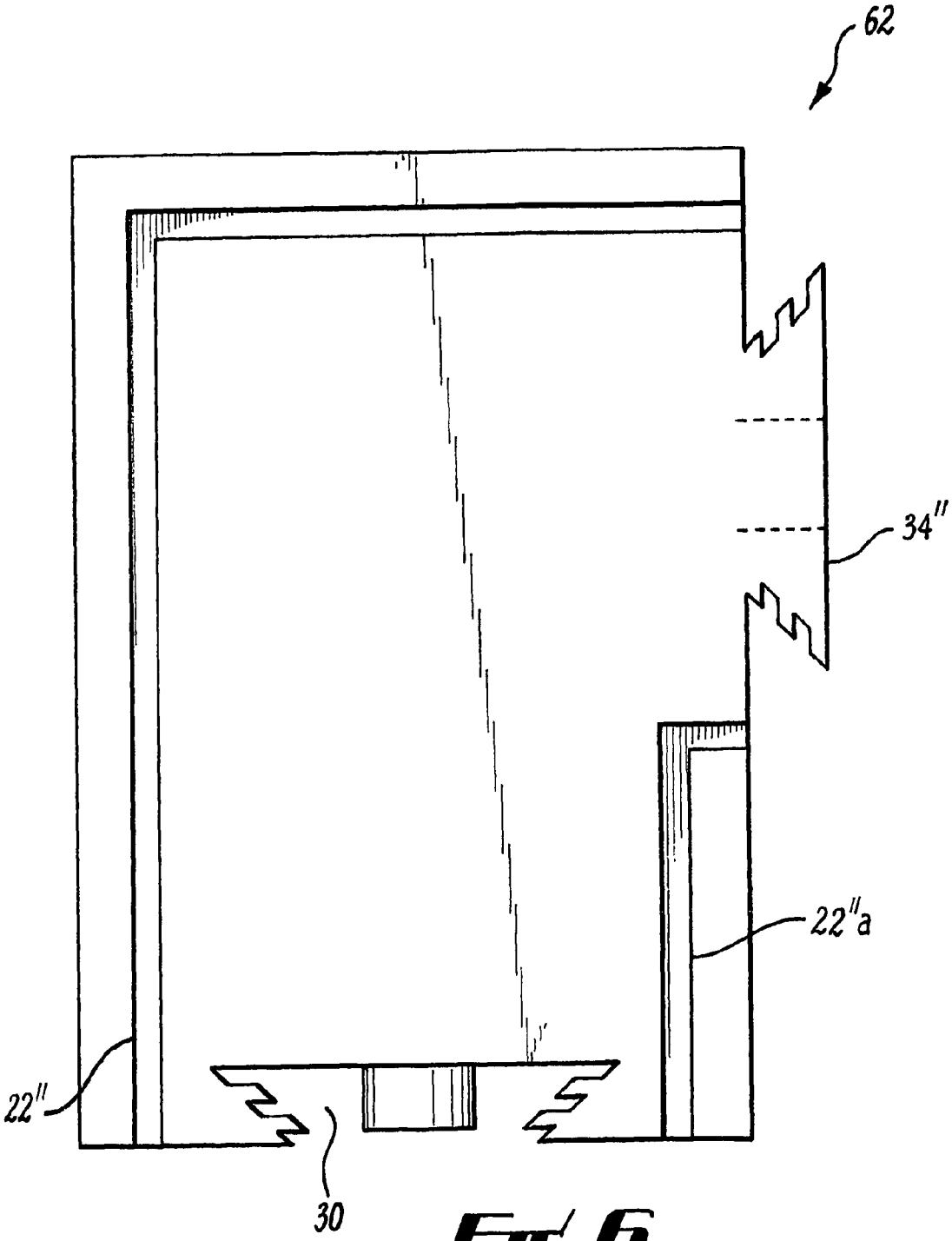

FIG. 6 shows, in plan, a further device, referenced 62, for use in a corner of a rectangular structure, in which, as in the element of FIGS. 1 to 3, a dovetail section vertical groove 30 is provided at one end of the device, but in which there is no dovetail section rib at the opposite end of the device, but instead a dovetail section vertical rib 34" projects from one side face of the device adjacent the end remote from the dovetail section groove, so that devices of the form shown in FIGS. 1 to 3 can be linked to the device of FIG. 6 via the groove 30 at one end of device 62 and linked to the rib 34" on the side of the device 62 to form, with the device 62, a right-angled corner of a structure. In the device of FIG. 6, the grooves 22" corresponding to groove 22 in FIGS. 1 to 3 extend through a right angle, the outer groove 22" on the side remote from dovetail rib 34" following that side up to a location close to the end remote from groove 30, then proceeding parallel with and spaced from the end face at that end, to the side face from which rib 34" extends, whilst the inner groove 22"*a* follows the side face from which rib 34" extends up to a location close to that rib then proceeds through a right angle to that side face, the arrangement being, of course, such that the grooves 22", 22"*a* are aligned with the grooves 22 of a device 8 linked by its dovetail groove 30 with rib 34" of the device 62.

It will be understood that devices corresponding to that of FIGS. 1 to 4 but of different lengths may be provided, for example to allow the devices to be laid in an interlocking bond fashion as illustrated in FIG. 4. Accordingly, it is possible, by using elements such as illustrated in FIGS. 5 and 6 in combination with elements of the form shown in FIGS. 1 to 3 to provide a structure in accordance with the invention completely surrounding a building or other area to be protected from flooding, or, conversely, to construct a continuous wall bounding a space which can be filled with a body of water whereby the structure may form, for example, a temporary reservoir.

Figure 7:
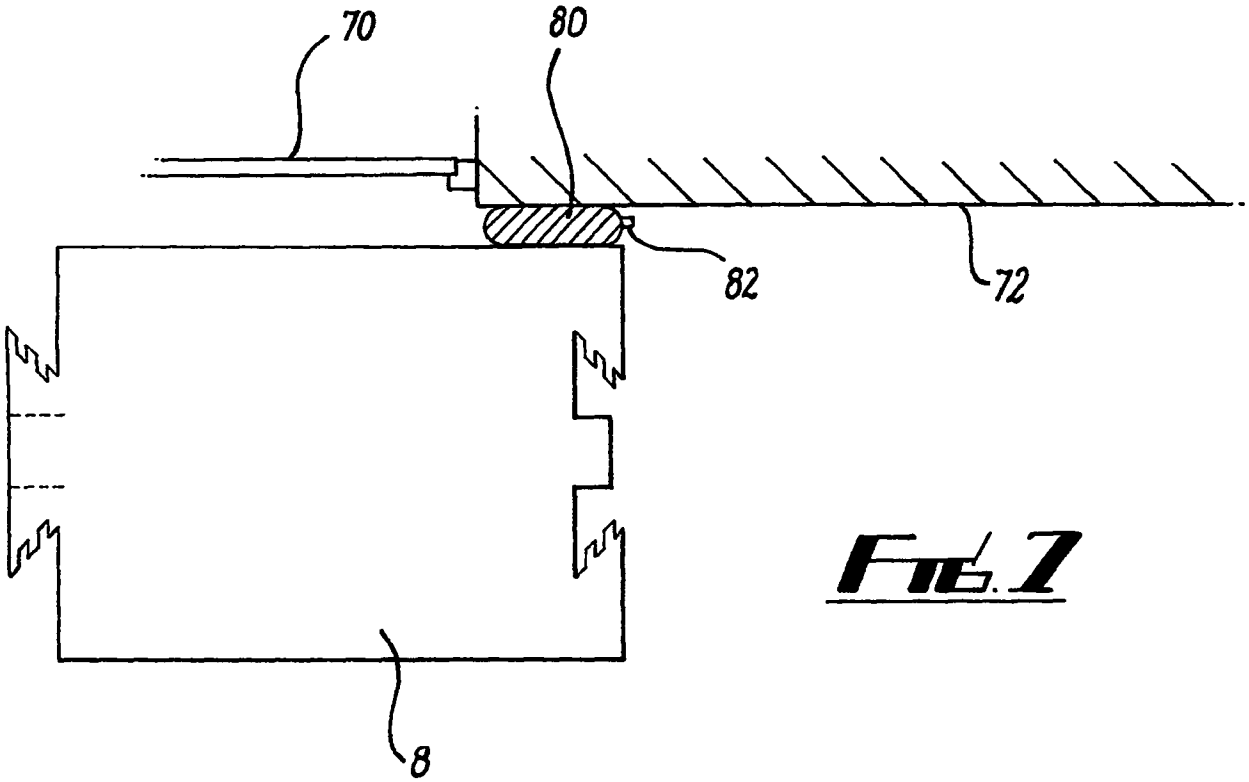
FIG. 7 is a schematic plan view illustrating use of the invention to protect a door opening in a building.

It is envisaged that devices in accordance with the invention may be used, for example, to prevent flood water from entering buildings via doorways or other openings. To this end, and referring to FIG. 7, the necessary number of devices 8 may, after filling with water, be assembled into a wall across a respective doorway or other opening 70 and may be sealed with respect to a building wall 72 adjacent the opening concerned by suitable sealing means. One such means envisaged, as illustrated in FIG. 7, comprises a bladder or balloon 80 which is interposed between the building wall 72 and the adjacent side face of the wall formed by devices 8 and is then inflated in situ via a valve 82 to provide a flexible seal between the building wall 72 and the wall of devices 8.

Figure 8:
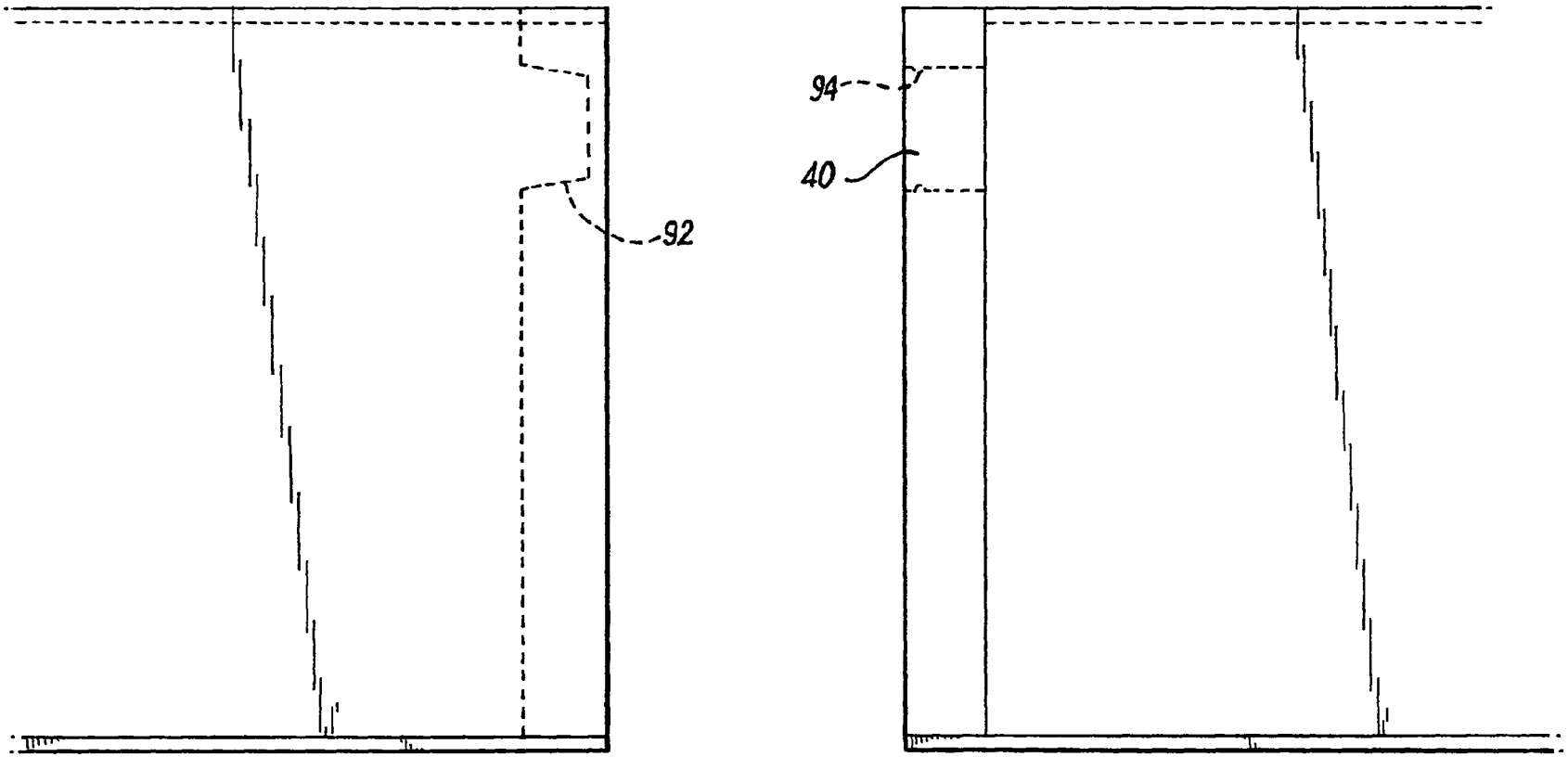
FIG. 8 is a schematic side view illustrating fluid connection between two adjoining devices in accordance with the invention.

As shown in FIGS. 1 to 3 and in broken lines in FIG. 8, in the preferred embodiment, each device 8 has a first opening 40 into its interior at one end defined by the socket 38 in the end face of the dovetail tongue or projection 34 and has a second, aligned opening 90 at its other end, through a tubular stub or spigot 92 which projects from the base or innermost face of the dovetail groove 30. As noted above, the devices 8 are formed from an elastomeric material such as polyurethane or rubber and the tubular spigot 92 of each device has its wall sufficiently thinned to allow the spigot 92 to flex downwards as the dovetail tongue 34 of an adjacent device 8 is passed downwards into the groove 30 without obstructing such movement, and is sufficiently resilient to spring back into a position in which it extends into the opening 40 in the dovetail tongue 34 of that adjacent device 8 when the dovetail tongue 34 is fully home in the groove 30. In order to ensure a sealing tight connection of the spigot 92 with the mating opening 40, an annular rib 94 (see FIG. 8) may be provided around the wall of the opening 40 for engagement with the exterior surface of the spigot 92, and the spigot 92 may taper inwardly towards its free end. The surfaces of the spigot 92 and/or the opening 40 could be coated with a lubricant to ease insertion.

The invention thus provides a jointing arrangement comprising a pair of complementary members which in this example are in the form of a pair of adjacent devices 8, each member 8 including a retaining formation engageable with the retaining formation of the other member, the retaining formations being in the form of the dovetail section groove 30 and the dovetail tongue 34, which are arranged so that to move to an engaged condition the members 8 must be moved with a relative sliding and shearing movement, one member 8 including a socket 38, the other member 8 including a projecting spigot 92 arranged for engagement with the socket 38, the spigot 8 being arranged to deform to permit the engagement movement, and arranged to resume its original shape in engagement with the socket 8 in the engaged condition.

Figures 9, 10:
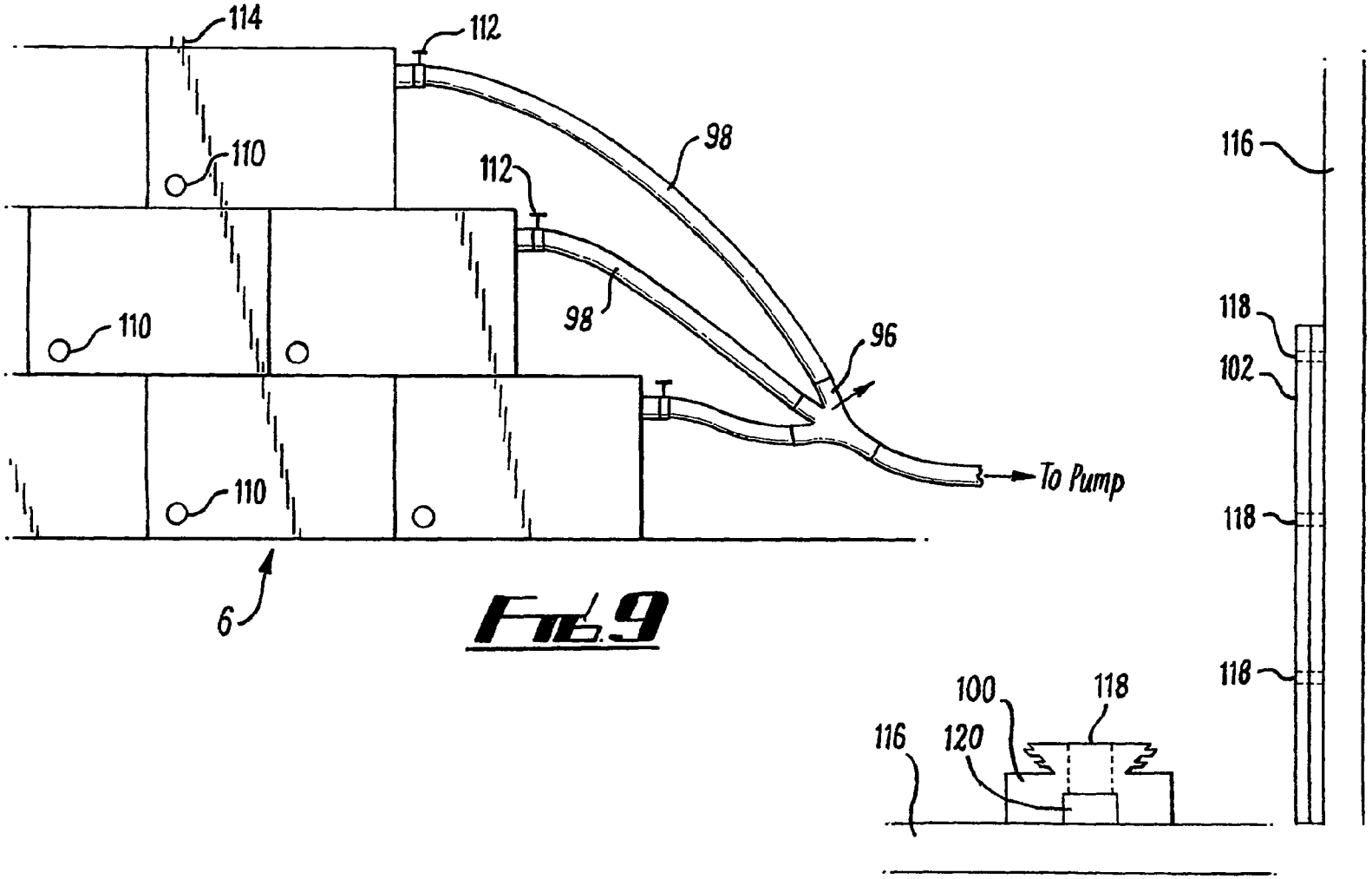
FIG. 9 illustrates the filling of a barrier constructed from devices in accordance with the invention with water.
FIG. 10 is a plan view illustrating how a building may be provided with a fixture for connection with a barrier in accordance with the invention.

The inter-engaging spigots 92 and openings 40 referred to above allow a whole horizontal series or course of interconnected devices 8 to be in fluid connection with one another through their openings 40, 90 whereby, as illustrated in FIG. 9 each course may be connected to the outlet of a water pump to allow the devices 8 to be filled with water in situ, after they have been assembled to form a structure 6 in the form of a wall in the manner described above. As illustrated in FIG. 9, several courses of devices 8 may be filled simultaneously from a single pump (not shown) using an appropriate multi-way connection 96 from which extend respective hoses 98 connected with respective courses of devices 8. The hoses 98 could be provided with shut-off valves 112 to retain the water within the devices, rather than using the bungs 42. One or some or all of the devices 8 could be provided or could be fitted with an air release vent 114 located in or towards an upper part such as the upper face 10 of the respective device to permit displacement of air from the device.

As illustrated in FIG. 9, the openings 40, 90 are disposed towards the upper surfaces of the devices 8 in the assembled barrier, each device 8 is preferably provided with a drain bung 110 in one side wall thereof adjacent the lower surface of the device to facilitate drainage after use.

As shown in FIG. 10, a building in a flood-prone area may be provided with adaptors 100 secured to a wall 116 and adapted for engagement with complementary ends of devices 8 of the form described above. In such case, the adapters 100 may be provided with openings 118 corresponding to the openings 40 in the devices 8, these openings being connected with a conduit connected with or connectable with a mains water supply, for example, or with a water pumping facility. The adaptors 100 could include a filling inlet 120 through which water may be introduced. Similarly, other adaptors 102 may be used which include connectable openings 118, but without complementary engaging parts adapted for engagement with the ends of the devices 8.

It is envisaged that devices 8 in accordance with FIGS. 1 to 3 might be two feet deep by two feet wide by three feet long (approximately 600 mm by 600 mm by 900 mm), giving an internal volume of approximately twelve cubic feet (0.324 $m^3$) and a weight, when filled with water, of around 750 lbs (350 kg). This weight, combined with the slight resilient flexibility of the devices, should ensure that a wall or barrier constructed as described above using such devices remains substantially watertight.

Figure 11:
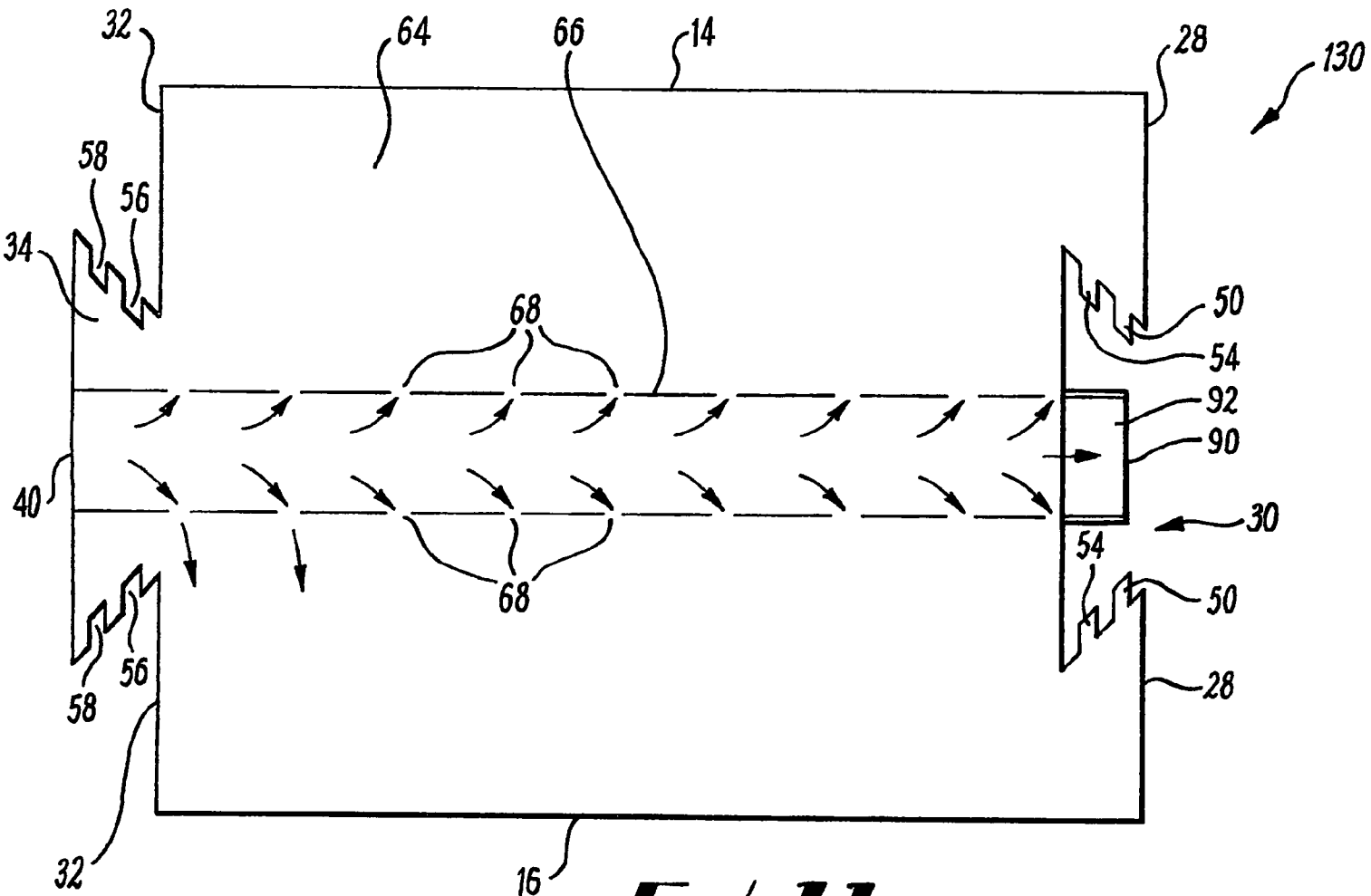
FIG. 11 is a schematic plan sectional view of another device.
Figure 12:
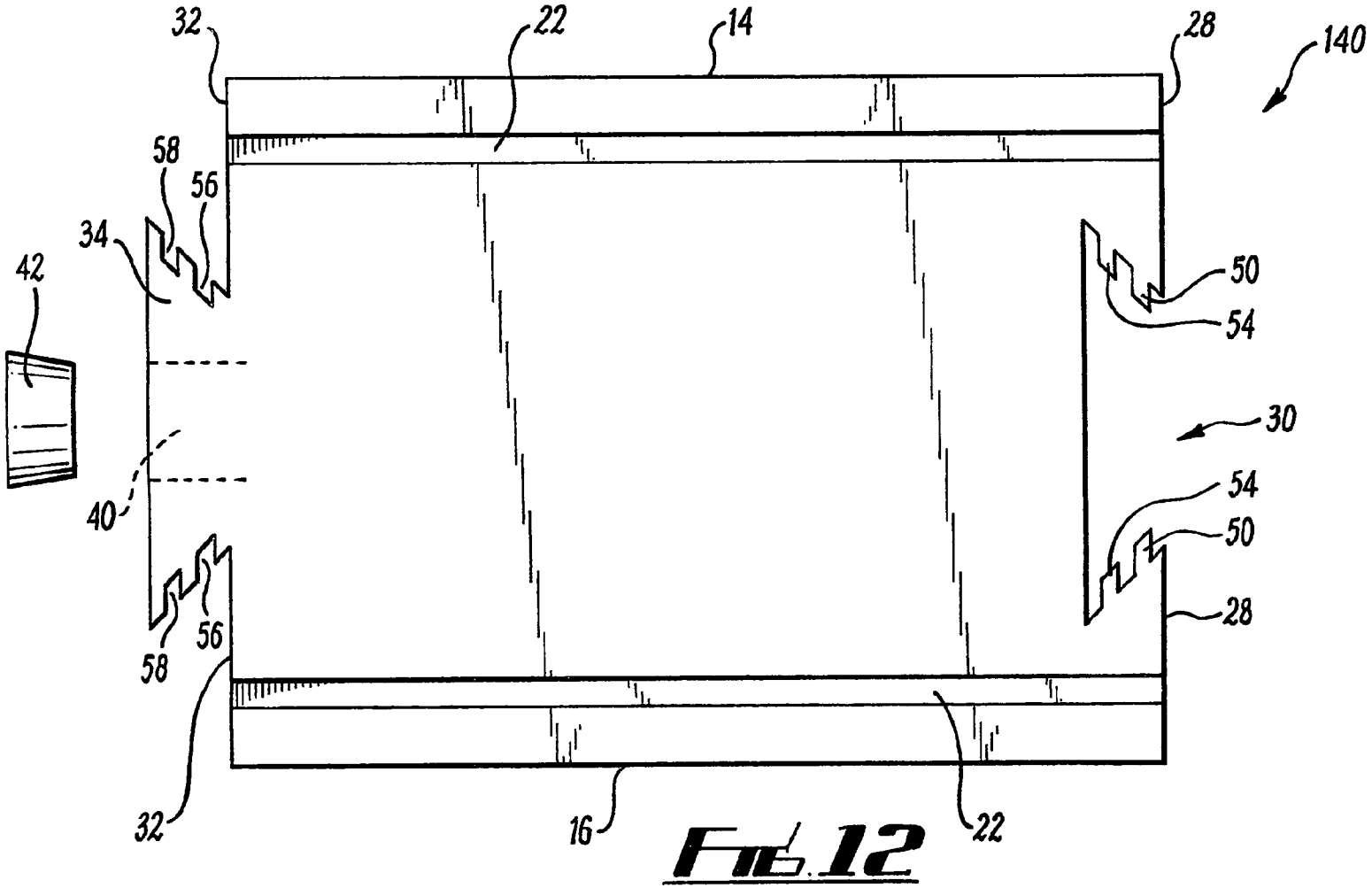
FIG. 12 is a schematic plan view of a further device.

FIGS. 11 and 12 show other embodiments of the invention, many features of which are similar to those previously described. Where features are the same or similar, the same reference numerals have been used, and for the sake of brevity only those features which are different will be described in detail.

FIG. 11 shows a device 130 which is hollow, defining an interior 64, in which a tube 66 extends from the opening 40 through the interior 64 to the spigot 90, the tube 66 defining a plurality of perforations or holes 68. When connected together with other devices 130 in series and being filled with water through the opening 40, the water flows along the tube 66 along the series of devices 130, flowing out through the holes 68 as indicated by the arrows in FIG. 11 along the whole length of the series of the devices 130 rather than filling each device in turn, thus evening out the filling of the devices 130 and preventing or reducing the risk of "blowback" which might otherwise occur.

FIG. 12 shows a device 140 which is a "standalone" version of the device 8 shown in FIGS. 1 to 3. The device 140 does not have a spigot 90 with a second opening 90, and thus requires that each device 140 is filled with water separately. In building a structure, each device 140 must be filled before a next device 140 is located in position.

Various other modifications could be made without departing from the scope of the invention. The device of the invention could be of any suitable size, shape or configuration. The filling, engaging, sealing and joint formations could be of any suitable size, shape, number or configuration, and could be located in any suitable position. The socket and the spigot formations could be located differently. For example, the socket and the spigot formations could be located in the upper and lower faces, or in the side faces.

The structures of the present invention could be of any suitable size, shape or configuration.

Devices in accordance with the invention may also be used, for example, to provide a water barrier in any location where such may be desired, for example as a flood barrier along a river bank or waterway or as a temporary sea wall where high seas or high tides present a risk of flooding. A barrier or wall constructed of devices in accordance with the invention may also be used as a traffic barrier or crash barrier, for example along a motorways or motor racing track, where the fact that the devices are filled with water may also serve to reduce the risk of fire in a crash situation.

The jointing arrangement of the invention could be used in different applications other than those described, where a self sealing joint is required, which can be made by simply bringing the members into engagement. The members could be formed of any suitable material. In one example, the spigot could be formed of a resiliently deformable material, while the other parts of the members could be formed of a different material which could be less or non resilient. However in practice it could be advantageous for the members to be formed of a resilient material as this aids sealing engagement between the members and permits easier movement into the engaged condition. It is also advantageous for the members to be formed integrally of the same material. The members could be formed by any suitable process, such as moulding.

The invention claimed is:

1. A flood defence or water-retaining device comprising a hollow body of an elastomeric material having formations at opposite ends for sealing engagement with complementary formations on adjoining flood defence devices and having complementary formations on upper and lower sides for sealing engagement with complementary formations on lower and upper sides respectively of any similar devices disposed respectively above and below the first-mentioned device, the device having at least one filling opening through which water can be passed into the interior of the device to fill the same, wherein the flood defence device has a first opening into its interior at one end, and has a second, aligned opening at its other end, through a projecting spigot complementary with said first opening for sealing engagement with said first opening of an adjoining identical device when a plurality of such devices are fitted together end to end, whereby a whole horizontal course of such devices may be filled with water via a said opening at one end of such course, and wherein the spigot comprises a tubular stub having a sidewall arranged to deform in a direction perpendicular to the center axis of the tubular stub, so that said sidewall folds to a position perpendicular to the center axis of the tubular stub when a shear force is applied to the spigot to permit placement of the adjacent device in position in engagement with the first mentioned device, and to spring back into position so that said sidewall moves to a position parallel to the center axis of the tubular stub when the engagement position is reached, in which position the spigot is in sealing engagement with the first opening of the adjoining device.

2. The flood defence or water-retaining device according to claim 1 wherein said formations at opposite ends of the device are complementary with each other, whereby the device can be connected in a series of identical devices arranged end-to-end with said formation at one end of the device sealingly engaging with the complementary formation at the adjoining end of the adjacent device.

3. The flood defence or water-retaining device according to claim 2 wherein each of said formations at said opposite ends is configured for interlocking engagement with the complementary said formation at the respective end of an identical device.

4. The flood defence or water-retaining device according to claim 3 wherein said complementary formations are of dove-tail form, comprising dove-tail section projections and grooves.

5. The flood defence or water-retaining device according to claim 1, wherein said upper and lower sides of the device comprise substantially flat surfaces interrupted by locating projections and recesses.

6. The flood defence or water-retaining device according to claim 5 wherein the locating projections on one of said flat surfaces comprise projecting ribs extending from end to the other of the device and the other of said flat surfaces comprises complementary grooves extending from one end to the other end of the device.

7. The flood defence or water-retaining device according to claim 1, in which the device includes a releasable closure for sealingly closing the opening.

8. A flood defence or water-retaining structure comprising a plurality of devices, each device being according to claim 1.

9. The structure according to claim 8, in which the devices are filled with water and connected one on top of another to form a sealed structure.

10. The structure according to claim 8, in which the devices are filled with water and connected end to end to form a sealed wall.

11. The structure according to claim 10, in which the structure comprises a second plurality of devices which are likewise filled with water and connected end-to-end sealingly, each device of said second plurality being superimposed on and sealingly engaging a device or devices of the first plurality.

12. A method of providing flood defence or retaining water, the method including the step of providing a device according to claims 1, and substantially filling the device with water.

13. A method of providing flood defence or retaining water, the method including the steps of providing a plurality of devices, the devices being according to claim 1, and forming a structure by locating the devices together so that each device is in sealing engagement with one or more neighbouring devices.

14. A method according to claim 13, in which the structure includes one or more courses of devices, each course including a plurality of devices, and the method includes the step of filling with water every device in the or each course of devices by connecting a water supply to one device of the or each course only.

* * * * *

UNITED STATES PATENT AND TRADEMARK OFFICE

CERTIFICATE OF CORRECTION

PATENT NO. : 8,454,269 B2
APPLICATION NO. : 12/669439
DATED : June 4, 2013
INVENTOR(S) : Johnson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 348 days.

Signed and Sealed this
Eighth Day of September, 2015

Michelle K. Lee

Michelle K. Lee
*Director of the United States Patent and Trademark Office*